US005320802A

United States Patent [19]

Liu et al.

[11] Patent Number: 5,320,802

[45] Date of Patent: Jun. 14, 1994

[54] CORROSION RESISTANT IRON ALUMINIDES EXHIBITING IMPROVED MECHANICAL PROPERTIES AND CORROSION RESISTANCE

[75] Inventors: Chain T. Liu, Oak Ridge; Claudette G. McKamey, Knoxville; Peter F. Tortorelli, Knoxville; Stan A. David, Knoxville, all of Tenn.

[73] Assignee: Martin Marietta Energy Systems, Inc., Oak Ridge, Tenn.

[21] Appl. No.: 884,530

[22] Filed: May 15, 1992

[51] Int. Cl.[5] ..... C22C 38/06

[52] U.S. Cl. ..... 420/81

[58] Field of Search ..... 420/81

[56] References Cited

U.S. PATENT DOCUMENTS 4,961,903 10/1990 McKamey et al. .
5,084,109 1/1992 Sikka .

OTHER PUBLICATIONS

*Influences of Compositional Modifications on the Corrosion of Iron Alumindes by Molten Nitrate Salts,* P. F. Tortorelli and P. S. Bishop, published Jan. 1991.

*Microstructure and Tensile Properties of Fe-40 At. Pct Al Alloys with C, Zr, Hf, and B Additions,* D. J. Gaydosh, S. L. Draper, and M. V. Nathal, Metallurgical Transactions vol. 20A, Sep. 1989.

*Commentaries and Reviews, A review of recent developments in $Fe_3Al$-based alloys, Metals and Ceramics Division,* vol. 6, No. 8 Aug. 1991 Oak Ridge National Laboratory, Oak Ridge, Tenn. 37831-6115, C. G. McKamey, et al.

*Tensile Properties of NiAl and NiTi,* vol. 94, 1966, A. G. Rozner and R. J. Wasilewski; Journal of the Institute of Metals, vol. 94, 1966.

*Primary Examiner*—Deborah Yee

*Attorney, Agent, or Firm*—Mark S. Graham; Robert O. Fox; J. Donald Griffin

[57] ABSTRACT

The specification discloses a corrosion-resistant intermetallic alloy comprising, in atomic percent, an FeAl iron aluminide containing from about 30 to about 40% aluminum alloyed with from about 0.01 to 0.4% zirconium and from 0.01 to about 0.8% boron. The alloy exhibits considerably improved room temperature ductility for enhanced usefulness in structural applications. The high temperature strength and fabricability is improved by alloying with molybdenum, carbon, chromium and vanadium.

6 Claims, 9 Drawing Sheets

(a)

(b)

(b)

CORROSION RESISTANT IRON ALUMINIDES EXHIBITING IMPROVED MECHANICAL PROPERTIES AND CORROSION RESISTANCE

The U.S. Government has rights in this invention pursuant to contract No. DE-AC05-840R21400 between the U.S. Department of Energy, Advanced Industrial Concepts Materials Program, and Martin Marietta Energy Systems, Inc.

The present invention relates to metal compositions and more particularly relates to a corrosion resistant intermetallic alloy which exhibits improved mechanical properties, especially room temperature ductility, high-temperature strength, and fabricability.

There are a great many systems and processes which require structural materials that must be able to withstand harsh, corrosive conditions. For example, in the production of certain chemicals, the containment vessels, conduits, etc. must exhibit acceptable resistance to corrosive attack from aggressive substances at high temperatures and pressures.

Known metal compositions suffer from various disadvantages which limit their usefulness in such applications. For example, metal compositions which exhibit sufficient corrosion resistance to strong oxidants at high temperatures tend to be very expensive or cost prohibitive, or lack sufficient room temperature ductility or strength for use as structural components. There is a need for an economical metal composition which exhibits acceptable corrosion and oxidation resistance and has sufficient ductility and strength for structural use in hostile environments.

Accordingly, it is an object of the present invention to provide a metal composition for structural parts exposed to corrosive conditions.

Another object of the invention is to provide a metal composition which exhibits acceptable corrosion resistance to chemical attack at high temperatures.

A further object of the invention is to provide a metal composition which exhibits an improved combination of mechanical and chemical properties.

Still another object of the invention is to provide a metal composition which is resistant to corrosion under harsh, oxidizing and sulfidizing conditions while exhibiting sufficient room-temperature ductility, weldability, high-temperature strength, and fabricability for structural use.

An additional object of the invention is to provide a metal composition of the character described which comprises readily available components which are relatively inexpensive so that the resulting composition is a cost-effective material having a wide range of applications.

Yet another object of the invention is to provide a method for making a metal composition having the aforedescribed attributes.

Having regard to the above and other objects, the present invention is directed to a corrosive resistant intermetallic alloy which exhibits improved mechanical properties that are of concern in structural and coating applications. In general, the alloy comprises, in atomic percent, an FeAl iron aluminide containing from about 30 to about 40% aluminum alloyed with from about 0.01 to 0.4% zirconium and from about 0.01 to about 0.8% boron. The FeAl iron aluminides of the invention exhibit superior corrosion resistance in many aggressive environments, particularly at elevated temperatures.

For example, the alloys of the invention are resistant to chemical attack resulting from exposure to strong oxidants at elevated temperatures, high temperature sulfidation, exposure to hot mixtures of oxidizing and sulfidizing substances (e.g., flue-gas-desulfurization processes, exposure to high temperature oxygen/chlorine mixtures, and in certain aqueous or molten salt solutions). The FeAl iron-aluminide alloys also exhibit substantially improved room-temperature ductility, which is a property of critical importance to usefulness in structural applications. The ductility is further improved by forging at about 700°-900° C. or hot extrusion (if applicable) at 650° to 800° C.

Further improvements in the mechanical properties of the FeAl iron aluminides of the invention are achieved by alloying with chromium and vanadium. Addition to the above-described alloys of from about 0.1 to 0.7% molybdenum yields alloys which combine the excellent corrosion resistance of the iron aluminide base with substantially improved high temperature strength to provide superior materials for structural parts in hostile environments. Also, additions of carbon, and/or from about 0.01 to about 7% chromium, and/or from about 0.01 to about 2% vanadium yields alloys having further improved properties.

The foregoing and other features and advantages of the present invention will now be further described in the following specification with reference to the accompanying drawings in which.

Figure 4A:
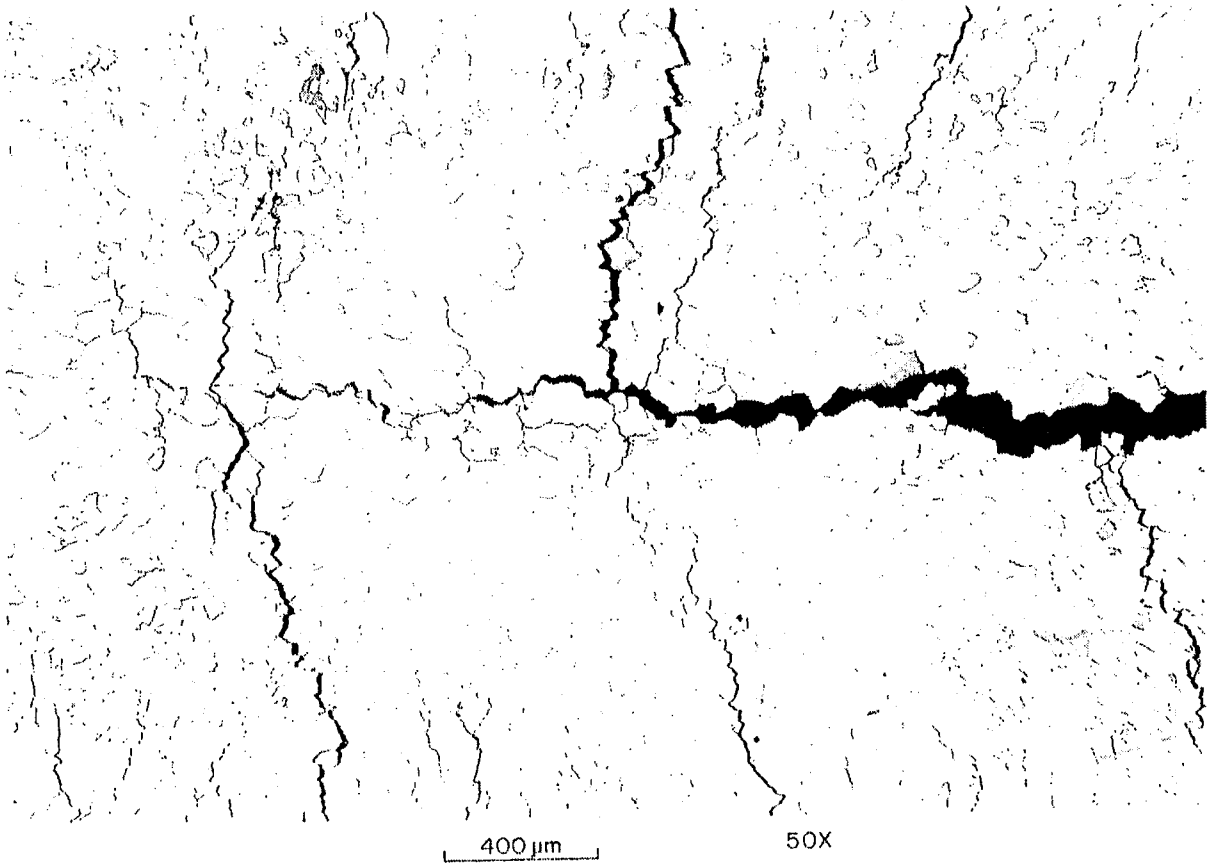
Figure 4B:
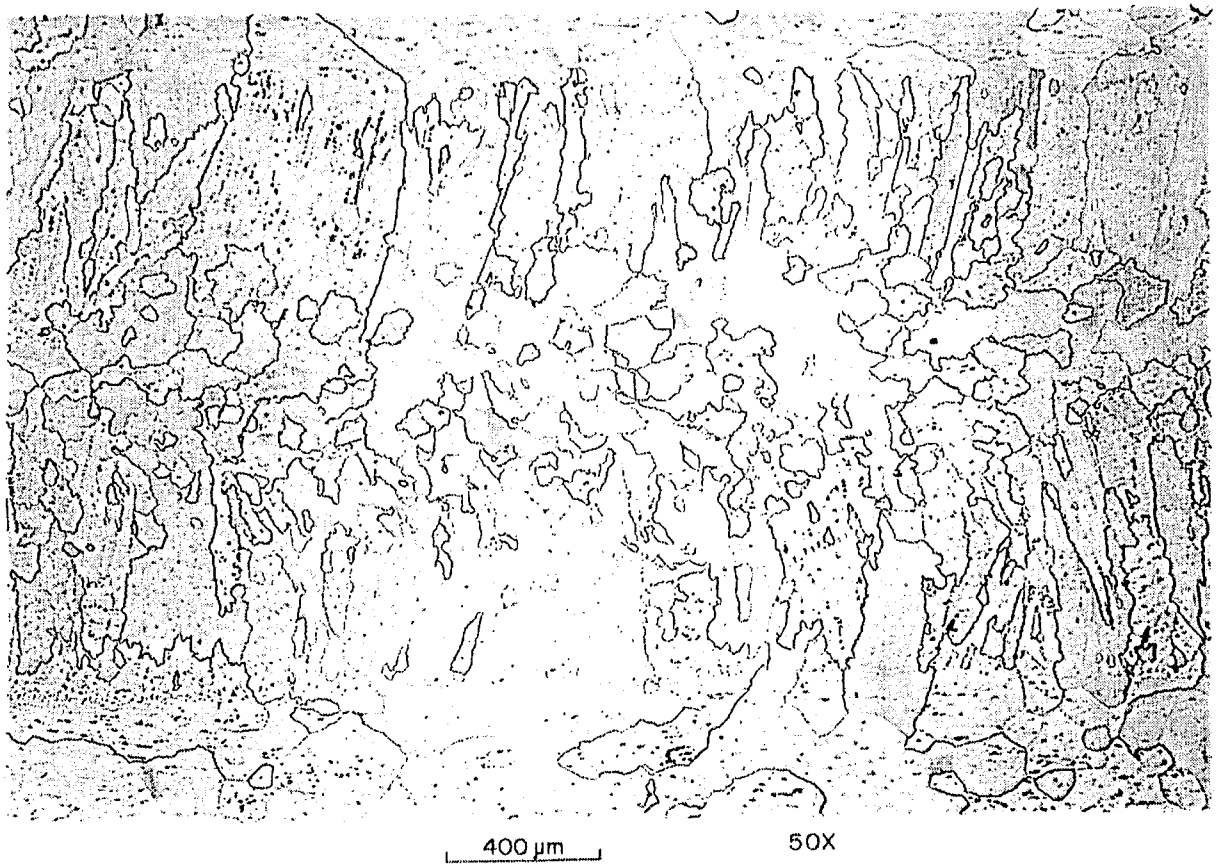
Figure 5A:
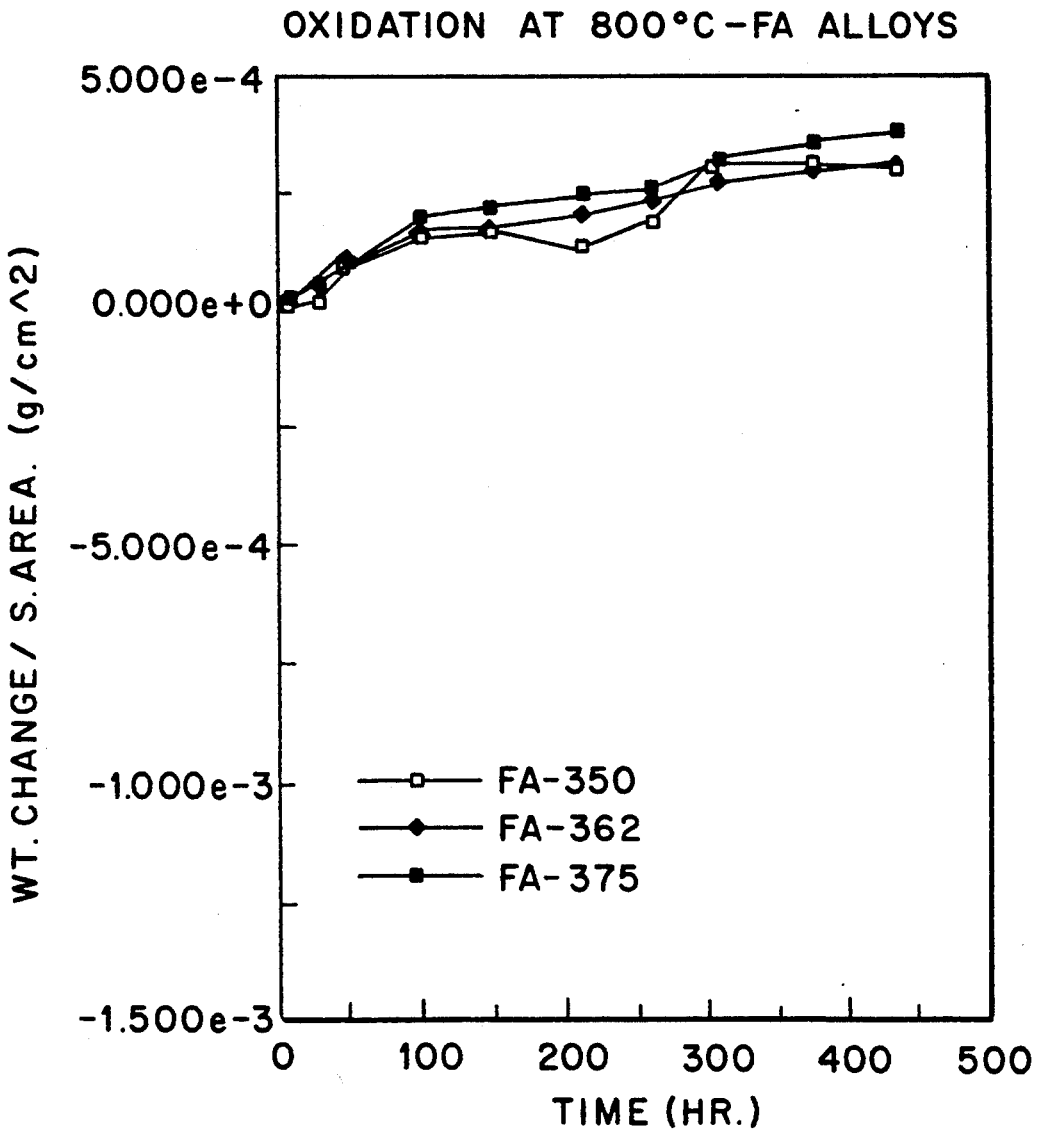
Figure 5B:
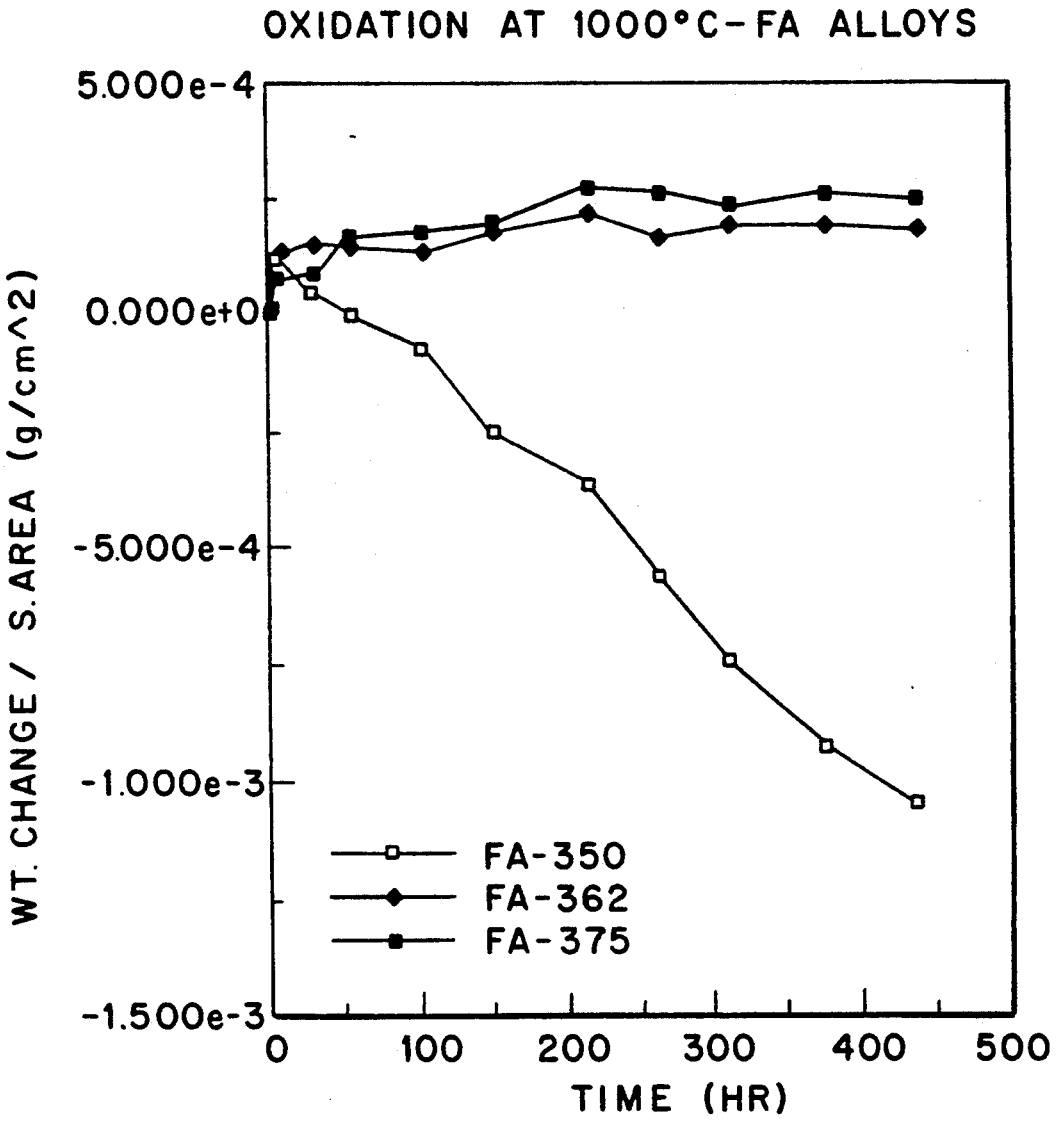
Figure 6A:
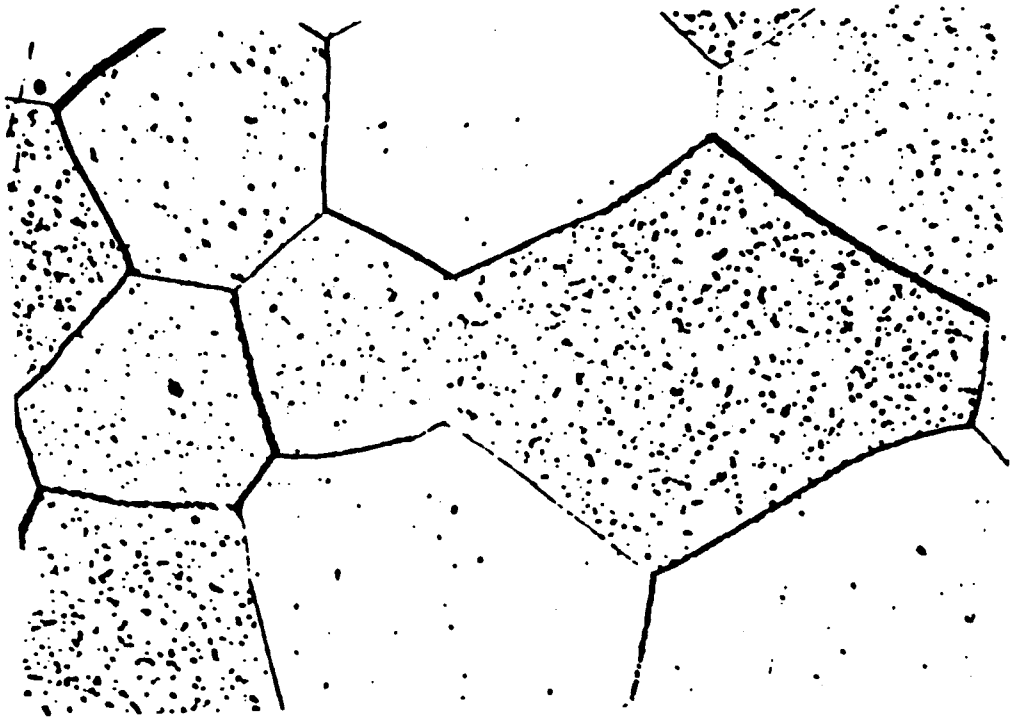
Figure 6B:
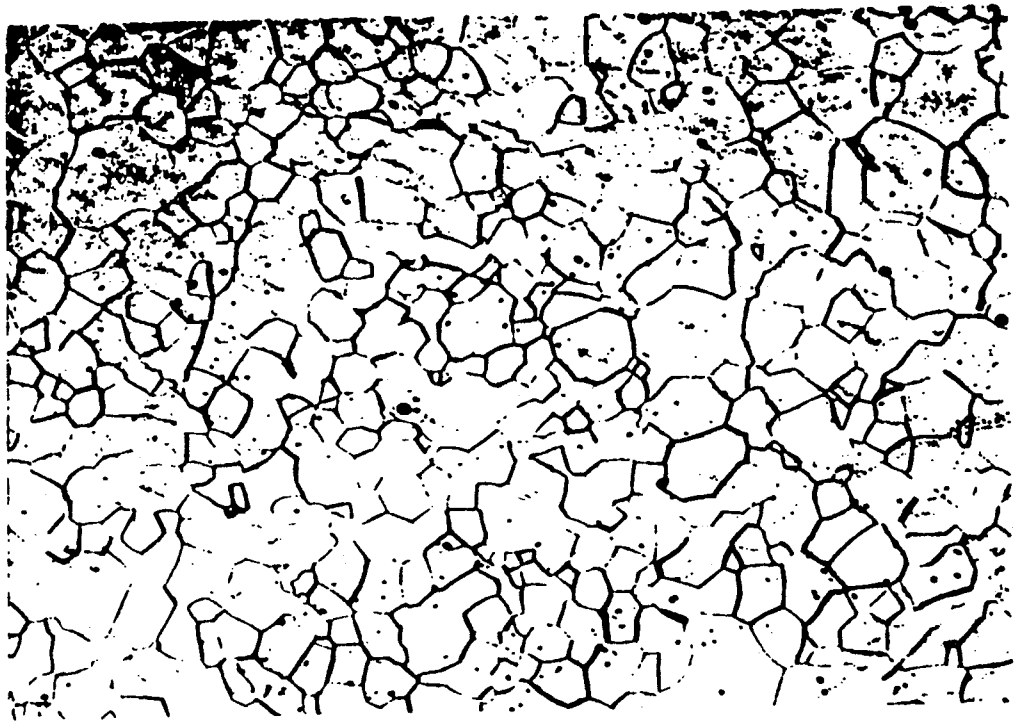
Figure 6B:
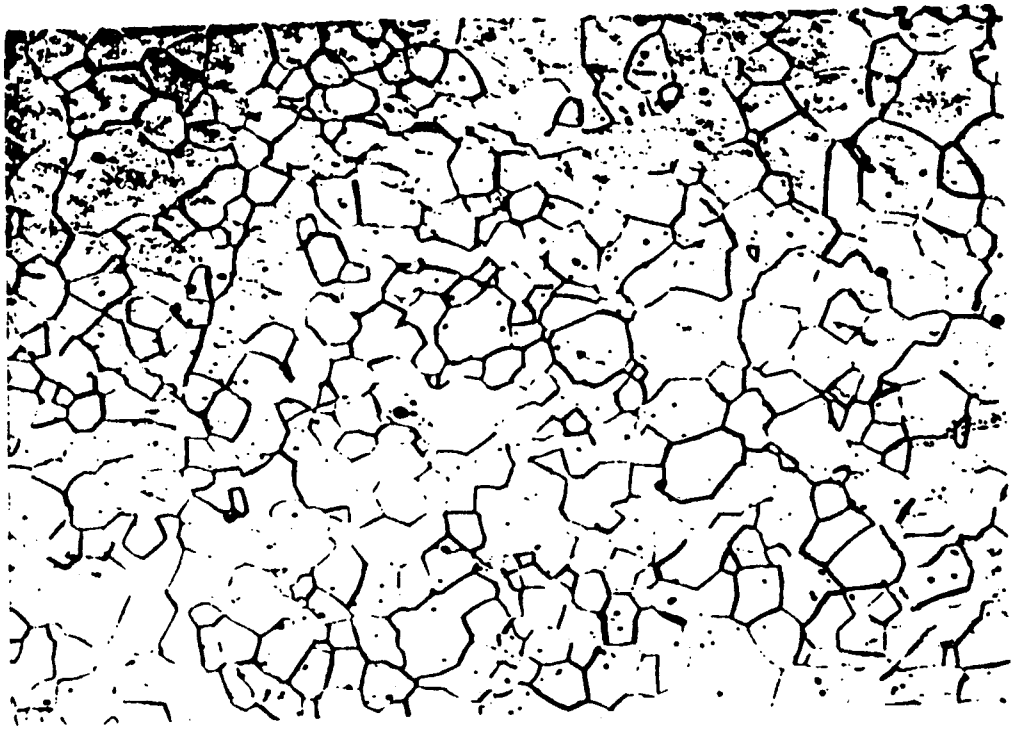

FIGS. 4*a* and 4*b* are photographic enlargements illustrating welding cracks formed in a boron containing FeAl alloy but not in a carbon-containing FeAl alloy;

FIGS. 5*a* and 5*b* are graphs illustrating relationships between air exposure time and weight change for FeAl iron aluminides tested at 800° and 1000° C., respectively; and FIGS. 6*a* and 6*b* are photographic enlargements illustrating the grain structure of an FeAl iron aluminide produced by hot rolling as compared with an FeAl iron aluminide produced by hot extrusion.

The present invention may be generally described as an intermetallic alloy having an FeAl iron aluminide base containing from about 30% to about 40% aluminum with alloying additions of from about 0.01% to 0.4% zirconium and from about 0.01% to about 0.8% boron. In most applications, it is preferred to include molybdenum. In this case, the alloy preferably includes from about 30 to about 39% aluminum with alloying additions of from about 0.1 to about 0.4% zirconium, from about 0.1 to about 0.7% molybendum, and from about 0.01 to about 0.8% boron. The alloy preferably also contains from about 0.01% to about 7% chromium, and/or from 0.01% to about 2% vanadium, and/or carbon.

As used herein, the terminology "intermetallic alloy" refers to a metallic composition wherein two or more metal elements are associated in the formation of the superlattice structure. The terminology "iron aluminide" refers to those intermetallic alloys containing iron and aluminum in the various atomic proportions; e.g., $Fe_3Al$, $Fe_3Al$, FeAl, $FeAl_2$, $FeAl_3$ and $Fe_2Al_5$. The present invention is particularly directed to an iron aluminide based on the FeAl phase. As described in McKamey, et al, "A Review of Recent Developments in $Fe_3Al$-Based Alloys", *Journal of Material Research,* Volume 6, No. 8 (August 1991), the disclosure of which is incorporated herein by reference, the unit cell of the FeAl superlattice is a B2 crystal structure in the form of a body-centered-cubic cell with iron on one sub-lattice and aluminum on the other. As used herein, the terminology "FeAl iron aluminide" refers to an intermetallic composition predominated by the FeAl phase.

The FeAl base in the intermetallic alloys of the invention exhibits considerable resistance to corrosion from various aggressive substances, particularly at high temperatures. To demonstrate the corrosion resistance properties and to determine some basic mechanical properties of the FeAl iron aluminides, several alloy ingots containing 30 to 43 atomic percent aluminum were prepared by arc melting and drop casting. The compositions of the ingots are shown below in Table 1.

TABLE 1

Composition of Binary FeAl Alloys

| Alloy Number | Composition (at. % Al) |
|---|---|
| FA-315 | 30.0 |
| FA-316 | 32.5 |
| FA-317 | 35.0 |
| FA-318 | 36.5 |
| FA-319 | 38.0 |
| FA-320 | 40.0 |
| FA-321 | 43.0 |

The alloys were clad in steel plates and fabricated into 0.76 millimeter thick sheets by hot rolling at temperatures of 900° to 1100° C. Tensile and creep specimens prepared from sheet stock were subjected to a standard heat treatment of 1 hour at about 800° to about 900° C. for recrystallization and 2 hours at 700° C. for ordering into a B2 structure.

Figure 1:
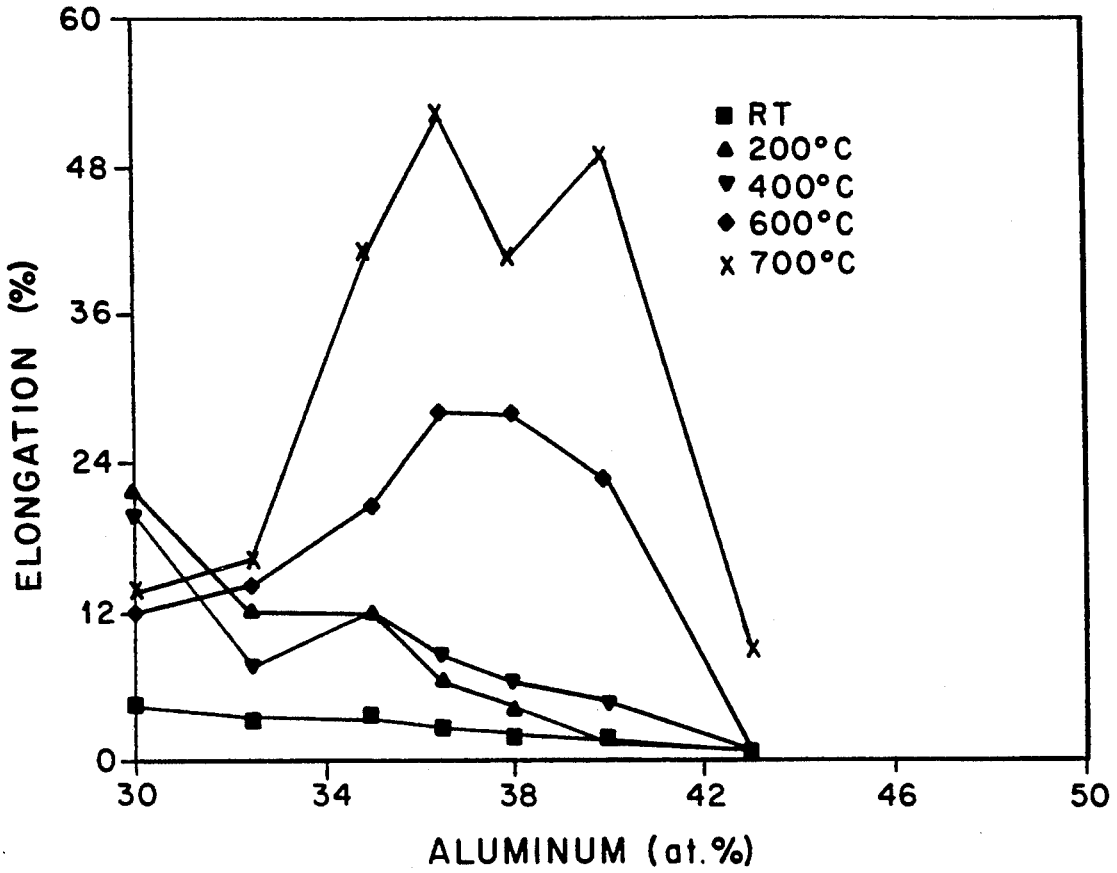
FIG. 1 is a graphical view illustrating a relationship between the aluminum content of FeAl iron aluminides and percent tensile elongation at various temperatures.

Tensile properties of the aluminide alloys were investigated as a function of temperature to 700° C. in air. FIG. 1 is a plot of tensile elongation as a function of aluminum concentration. The alloys show a slight increase in yield strength with aluminum at temperatures to 400° C. The strength becomes insensitive to the aluminum concentration at 600° C. and it shows a general decrease with aluminum at 700° C. At room temperature, the elongation shows a general trend of decreasing with the aluminum level. At elevated temperatures, the ductility exhibits a peak around 35% to 38% Al.

The creep properties of FeAl-based iron aluminides were characterized by testing at 593° C. (1200° F.) and 30 ksi in air. The results are show in Table 2.

TABLE 2

Creep Properties of FeAl Alloys Tested at 30 ksi and 593° C.

| Alloy Number | Al | Rupture Life (h) |
|---|---|---|
| FA-315 | 30.0 | 2.6 |
| FA-316 | 32.5 | 4.5 |
| FA-317 | 35.0 | 2.0 |
| FA-318 | 36.5 | 1.8 |
| FA-319 | 38.0 | 0.8 |
| FA-320 | 40.0 | 0.6 |

TABLE 2-continued

Creep Properties of FeAl Alloys Tested at 30 ksi and 593° C.

| Alloy Number | Al | Rupture Life (h) |
|---|---|---|
| FA-321 | 43.0 | 0.2 |

In general, the creep properties show a slight decrease with increasing aluminum concentration.

Figure 2:
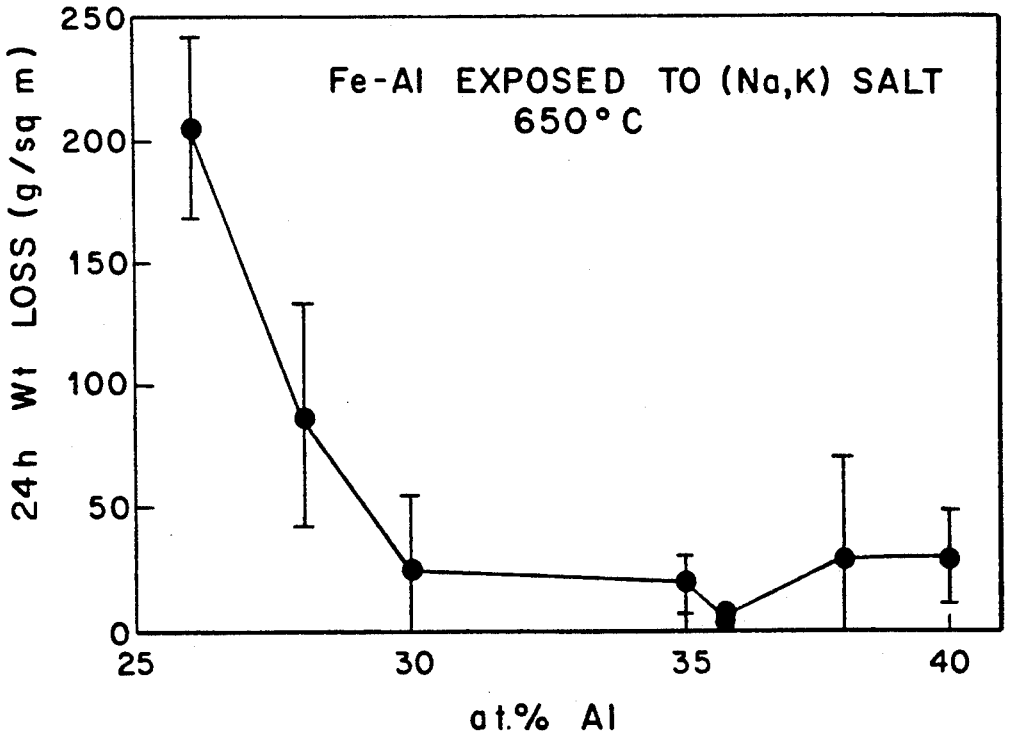
FIG. 2 is a graphical view illustrating a relationship between the aluminum content of FeAl iron aluminides and weight change from exposure to a high-temperature oxidizing molten-salt solution.
Figure 3:
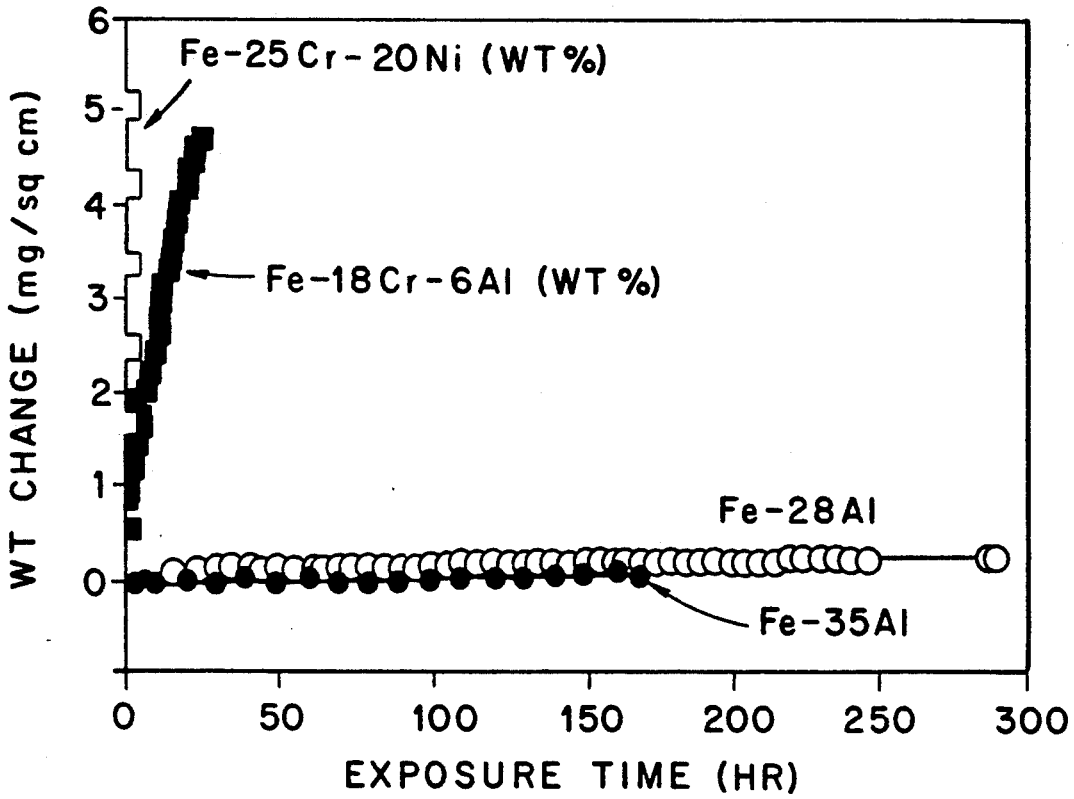
FIG. 3 is a graphical view illustrating a relationship between exposure time and weight change for FeAl iron aluminides exposed to a high-temperature corrosive-gas mixture.

The corrosion of FeAl iron aluminides exposed to a molten nitrate-peroxide salt is illustrated in FIG. 2. As shown, the corrosion resistance does not dramatically change as a function of aluminum concentration once a minimum of 30% is achieved. However, it is prudent to have an aluminum concentration in excess of the minimum value to guard against localized breakdown of the aluminum-containing surface product. As shown in FIG. 3, the FeAl based alloys exhibit excellent resistance to oxidation/sulfidation even at low oxygen partial pressures (i.e. $10^{-22}$ atm).

Overall, an FeAl iron aluminide containing about 36% Al is believed to provide an optimal combination of corrosion resistance and mechanical properties. However, the relatively poor room temperature ductility of FeAl iron aluminides has limited their usefulness in structural applications.

In accordance with the invention, it has been found that additions of zirconium and boron to FeAl iron aluminides substantially improve the room temperature ductility of the compositions. To illustrate the beneficial effects of zirconium and boron, FeAl ingots were prepared containing 0.1 at.% zirconium or 0.12 at.% boron and the tensile properties were tested at room temperature (70° C.), 200° C. and 600° C. The results are shown below in Table 3.

TABLE 3

Effect of Zr and B on Tensile Properties of Fe-35.8% Al

| Alloy Additions (at. %) | Elongation (%) | Yield Strength (ksi) | Tensile Strength (ksi) |
|---|---|---|---|
| | Room Temperature | | |
| 0 | 2.2 | 51.5 | 59.4 |
| 0.10 Zr | 4.6 | 41.0 | 61.7 |
| 0.12 B | 5.6 | 52.8 | 82.4 |
| | 200° C. | | |
| 0 | 9.0 | 45.9 | 83.6 |
| 0.10 Zr | 10.8 | 38.0 | 88.5 |
| 0.12 B | 11.0 | 46.4 | 99.9 |
| | 600° C. | | |
| 0 | 20.1 | 48.2 | 57.2 |
| 0.10 Zr | 25.8 | 43.5 | 59.9 |
| 0.12 B | 40.0 | 46.3 | 57.5 |

From Table 3, it is seen that alloying with 0.12% boron produces a 250% increase in the room temperature ductility from 2.2% to 5.6%, and alloying with zirconium produces a more than two-fold increase in the ductility at room temperature and at 600° C. Zirconium lowers the yield strength at room and elevated temperatures, whereas boron does not significantly affect the strength.

The effect of adding both boron and zirconium and the ratio of boron to zirconium is shown below in Table 4.

TABLE 4

Tensile Properties of Fe-35.8% Al Alloyed With A Combination of B and Zr

| Alloy Composition (at. %) | Elongation (%) | Yield Strength (ksi) | Tensile Strength (ksi) |
|---|---|---|---|
| | Room Temperature | | |
| 0 | 2.2 | 51.5 | 59.0 |
| 0.1 Zr + 0.12 B | 2.6 | 42.1 | 51.9 |
| 0.1 Zr + 0.24 B | 4.8 | 46.5 | 71.0 |
| 0.1 Zr + 0.40 B | 4.8 | 43.2 | 71.0 |
| | 200° C. | | |
| 0 | 9.0 | 45.9 | 83.6 |
| 0.1 Zr + 0.12 B | 6.5 | 39.1 | 69.4 |
| 0.1 Zr + 0.24 B | 9.6 | 42.8 | 87.0 |
| 0.1 Zr + 0.40 B | 12.0 | 41.4 | 94.6 |
| | 600° C. | | |
| 0 | 20.1 | 48.2 | 57.2 |
| 0.1 Zr + 0.12 B | 13.8 | 44.3 | 59.1 |
| 0.1 Zr + 0.24 B | 20.3 | 54.0 | 65.2 |

It is surprisingly noted from Table 4 that a simple combination of zirconium and boron does not give an expected beneficial effect as for the 0.1 Zr+0.12 B alloy. However, the 0.1 Zr+0.24 B and the 0.1 Zr+0.40 B alloys have better room temperature ductility and are also significantly stronger than the 0.1 Zr+0.12 B alloy or the alloy containing only boron or zirconium at room temperature and 600° C. Thus, it is preferred that the boron/zirconium ratio be in the order of at least about 2 to 1 and most preferably about 2.5 to 1. It is believed that maintenance of the B/Zr ratio in the 2/1 to 2.5/1 range provides a near $ZrB_2$ phase which refines the grain size and has a beneficial effect on the ductility of the compositions.

With reference to Table 5, there is shown the effect of the addition of molybdenum to the alloys of Table 4. Molybdenum at levels of up to about 1% was added to FeAl containing 0.05% Zr and 0.24% B to further improve the mechanical properties. Table 5 summarizes the tensile properties of the molybdenum-modified FeAl alloys tested at room temperature and 600° C. Alloying with 0.2% Mo increases both strength and ductility at room temperature. The alloy with 0.2% Mo has a tensile ductility of 11.8%, which is believed to be the highest ductility ever reported for FeAl alloys prepared by melting and casting. Further increases in a molybdenum concentration to 0.5% Mo or higher causes a decrease in room temperature ductility and strength. Additions of molybdenum also increase the yield and ultimate tensile strength of FeAl alloys at 600° C.

TABLE 5

Tensile Properties of Fe-35.5% Al-0.05% Zr - 0.24% B alloyed with Mo

| Alloy Composition (at. %) | Elongation (%) | Yield Strength (ksi) | Tensile Strength (ksi) |
|---|---|---|---|
| | Room Temperature | | |
| 0.05 Zr + 0.24 B | 10.7 | 47.2 | 109.6 |
| 0.05 Zr + 0.24 B + 0.2 Mo | 11.8 | 58.2 | 121.3 |
| 0.05 Zr + 0.24 B + 0.5 Mo | 9.7 | 53.2 | 109.4 |
| 0.05 Zr + 0.24 B + 1.0 Mo | 7.0 | 52.3 | 98.6 |
| | 600° C. | | |
| 0.05 Zr + 0.24 B | 56.6 | 54.9 | 52.2 |
| 0.05 Zr + 0.24 B + 0.2 Mo | 34.3 | 61.6 | 65.8 |
| 0.05 Zr + 0.24 B + 0.5 Mo | 35.1 | 57.2 | 71.2 |
| 0.05 Zr + 0.24 B + 1.0 Mo | 51.5 | 58.0 | 74.4 |

In accordance with yet another aspect of the invention, further improvements in the mechanical properties of FeAl iron aluminides are achieved by alloying with chromium, or a combination of vanadium and chromium, or a combination of chromium with molybdenum. Table 6 shows the tensile properties of FeAl iron aluminides alloyed with these additions.

TABLE 6

Tensile Properties of FeAl Alloys Produced by Hot Extrusion at 900° C.

| Alloy Number | Alloy Composition (at. %) | Elongation (%) | Strength (ksi) Yield | Strength (ksi) Ultimate |
|---|---|---|---|---|
| | Room Temperature | | | |
| FA-350 | 35.8 Al + 0.05 Zr + 0.24 B | 10.7 | 47.2 | 109.6 |
| FA-353 | 35.8 Al + 5 Cr + 0.1 Zr + 0.4 B | 6.1 | 51.6 | 92.7 |
| FA-356 | 35.8 Al + 5 Cr + 0.5 V + 0.8 B | 7.6 | 77.9 | 121.1 |
| FA-367 | 35.8 Al + 5 Cr + 0.5 Mo + 0.8 B | 7.6 | 74.9 | 122.1 |
| | 600° C. | | | |
| FA-350 | | 54.9 | 52.2 | 56.6 |
| FA-353 | | 66.4 | 49.1 | 59.9 |
| FA-356 | | 50.1 | 56.6 | 69.2 |
| FA-367 | | 32.9 | 64.8 | 79.9 |

As revealed by Table 6, alloying with 5 at.% Cr lowers the ductility at room temperature but does not significantly improve the strength of the FeAl alloy (FA-350). However, a combination of 5% Cr with 0.5% Mo or 0.5% V substantially improves the strength of FA-350 at both room temperature and 600° C.

Creep properties of several FeAl (35.8% Al) alloys were determined by testing at 20 ksi and 593° C. (1100° F.) in air, and the results are shown in Table 7. Additions of boron and zirconium, both of which improve the tensile ductility at ambient temperatures, extend the rupture life of the binary FeAl by a factor of about 2 at 593° C. A combination of 5.0% Cr and 0.5% V further extends the rupture life of FeAl alloys. Molybdenum at a level of 0.2% substantially increases the rupture life and reduces the creep rate of the binary alloy FA-350. Further increases in molybdenum concentration reduces rather than increases the creep resistance. The alloy FA-362 containing 0.2% Mo showed a rupture life of about 900%, which is longer than that of the binary alloy FA-334 by more than an order of magnitude. A combination of 0.5% Mo and 5% Cr (FA-367) also substantially extends the rupture life of FeAl.

TABLE 7

Creep properties of FeAl (35.8% Al) alloys tested at 20 ksi and 593° C. (1100° F.)

| Alloy Number | Composition (%) | Rupture life (h) | Minimum creep rate (%/h) | Rupture elongation (%) |
|---|---|---|---|---|
| FA-324 | Base[a] | 46.4 | 0.23 | 28.0 |
| FA-342 | 0.24 B + 0.1 Zr | 70.9 | 0.49 | 101.0 |
| FA-350 | 0.24 B + 0.05 Zr | 106.6 | 0.22 | 123.2 |
| FA-370 | 0.24 B + 0.1 Zr + 2 Cr | 73.4 | 0.45 | 101.5 |
| FA-369 | 0.24 B + 0.1 Zr + 5 Cr | 37.6 | 0.87 | >137.0 |
| FA-353 | 0.40 B + 0.1 Zr + 5 Cr | 104.8 | 0.27 | 85.4 |
| FA-368 | 0.40 B + 0.0 Zr + 5 Cr + 0.5 V | 130.6 | 0.17 | 85.6 |
| FA-356 | 0.80 B + 0.0 Zr + 5 Cr + 0.5 V | 164.1 | 0.20 | 80.9 |
| FA-362 | 0.24 B + 0.05 Zr + 0.2 Mo | 894.3 | 0.031 | 87.7 |
| FA-363 | 0.24 B + 0.05 Zr + 0.5 Mo | 209.7 | 0.16 | 98.6 |
| FA-364 | 0.24 B + 0.05 Zr + 1.0 Mo | 159.0 | 0.126 | 75.6 |
| FA-367 | 0.80 B + 0.0 Zr + 0.5 Mo + Cr | 710.0 | 0.040 | 63.8 |

[a]Fe-35.8 at. % Al.

The effect of alloying additions on the corrosion resistance of FeAl iron aluminides was investigated for exposure to molten nitrate-peroxide salts. The results are shown below in Table 8.

TABLE 8

Twenty-four hour weight losses of FeAl Alloys in molten $NaNO_3$—$KNO_3$-1 mol % $Na_2O_2$ (Na,K) and $NaNO_3$-0.4 mol % $Na_2O_2$ (Na) at 650° C.

| Alloy Designation | Weight loss (c/sq m) (Na,K) Average | Weight loss (c/sq m) Na Average |
|---|---|---|
| Fe—40Al | 31.3 | |
| Fe—40Al—4Cr | 11.6 | |
| Fe—40Al—8Cr | 7.8 | |
| Fe—38Al | 29.6 | |
| Fe—36.5Al | | 77.3 |
| Fe—36.5Al—2Cr | | 24.4 |
| Fe—36.5Al—4Cr | | 70.8 |
| Fe—36.5Al—6Cr | | 26.6 |
| Fe—35.8Al | | 19.3 |
| Fe—35.8Al—B | 3.3 | 6.3 |
| Fe—35.8Al—Zr | 1.1 | 4.2 |
| Fe—35.8Al—5Cr | 4.3 | 2.4 |
| Fe—35.8Al—ZrB | 11.4 | 21.6 |
| Fe—35Al | 19.6 | 70.9 |

Table 8 shows that an FeAl iron aluminide may contain up to 8% chromium without significantly compromising corrosion resistance to the sodium-based salt. For some compositions chromium improves corrosion resistance. While chromium concentrations greater than 2% may be detrimental for $Fe_3Al$ iron aluminides in oxidizing/sulfidizing environments, the higher Al levels of the FeAl iron aluminides of the present invention are believed to provide sufficient sulfidation protection so that higher Cr levels may be used.

The welding behavior of FeAl alloys based on FA-362 was studied using gas-tungsten-arc (GTA) welding at welding speeds ranging from 8.3 to 25 mm/s. The results are shown in Table 9 together with alloy compositions.

TABLE 9

The welding behavior of FeAl alloys

| Alloy Number | Composition, at % | Welding behavior |
|---|---|---|
| FA-362 | 35.8 Fe—0.2 Mo—0.05 Zr—0.24 B | cracked |
| FA-372 | 35.8 Fe—0.2 Mo—0.05 Zr | marginal |
| FA-383 | 35.8 Fe—0.2 Mo | no crack |
| FA-384 | 35.8 Fe—0.2 Mo—2.0 Cr | no crack |
| FA-387 | 35.8 Fe—0.2 Mo—0.24 B | cracked |
| FA-388 | 35.8 Fe—0.2 Mo—0.24 C | no crack |
| FA-385 | 35.8 Fe—0.2 Mo—0.05 Zr—0.12 C | no crack |

TABLE 9-continued

The welding behavior of FeAl alloys

| Alloy Number | Composition, at % | Welding behavior |
|---|---|---|
| FA-386 | 35.8 Fe—0.2 Mo—0.05 Zr—0.24 C | no crack |

The alloys FA-362 and FA-387 containing 0.24%B were found to crack severely during welding. Hot cracks occur during the last stages of weld solidification, while there is still a small volume of low freezing liquid present. Of the various alloy investigated, alloys FA-385, FA-386 and FA-388 containing carbon additions showed great promise. Successful welds free of hot cracks were produced in these three alloys, indicating that carbon additions improve weldability. FIG. 4*a* illustrates welding cracks formed in a boron containing alloy. FIG. 4*b* illustrates a carbon-containing alloy which does not have cracks.

Oxidation properties of FeAl alloys were determined by exposure to air for up to 800 h at 800 and 1000° C. FIGS. 5(*a*) and 5(*b*) show a plot of weight change in FA-350, FA-362 and FA-375 as a function of exposure time at 800° and 1000° C. The weight gain is due to formation of oxide scales on specimen surfaces, and weight loss is associated with oxide spalling. All three alloys showed a comparable weight gain after a 500 h exposure at 800° C. The alloy FA-350 containing no molybdium showed a substantial weight loss while FA-362 and FA-375 containing 0.2% exhibited a weight gain after a 500 h exposure at 1000° C.

These results clearly indicate that alloying with 0.2% Mo eliminates oxide spalling and improves oxidation resistance of FeAl alloys. Note that FA-362 and FA-375 showed less weight gain at 1000° C. than 800° C. indicating a rapid formation of Al-rich oxide scales which effectively protect the base metal from excessive oxidation at 1000° C.

Based on the foregoing, a particularly preferred composition in accordance with the invention comprises, in atomic percent, from about 34 to about 38% aluminum, from about 0.01% to about 0.4% zirconium, from about 0.1% to 0.6% Mo, from about 0.01% to about 0.8% boron and/or carbon, from about 0.01% to about 6% chromium and from about 0.01% to about 2% vanadium, and the balance iron. A highly preferable composition comprises about 36% aluminum, about 0.05% zirconium, about 0.2% Mo, about 0.2% boron and carbon, about 2% Cr and about 0.2% vanadium, and the balance iron.

The FeAl iron aluminides of the invention may be prepared and processed to final form by any of the known methods such as arc or air-induction melting, for example, followed by electroslag remelting to further refine the ingot surface quality and grain structure in the as-cast condition. The ingots may then be processed by hot forging, hot extrusion, and hot rolling.

It has been observed that the hot rolling procedure produces sheet materials with a coarse grain structure (grain diameter≈200 μm). It has been found that the ductility of FeAl iron aluminides can be further improved by refining grain structure through hot extrusion and controlled heat treatments at relatively low temperatures (i.e. 700° C.). To demonstrate these improvements, FeAl alloy ingots were hot clad in steel billets and hot extruded at 900° C. with an extrusion ratio of 12 to 1. As shown in FIGS. 6*a* and 6*b*, the hot extruded material had a grain size smaller than hot-rolled sheet material by a factor of about 7.

Table 10 illustrates the tensile properties of FeAl iron aluminides, containing boron and zirconium with different grain structures.

TABLE 10

Tensile Properties of FeAl (35.8% Al) Alloys Produced by Hot Rolling (Sheet Material) or Hot Extrusion (Rod Material)

| Alloy Number | Alloy Composition (at. %) | Elongation (%) | Strength (ksi) Yield | Strength (ksi) Ultimate |
|---|---|---|---|---|
| Room Temperature, Sheet Specimens (Coarse Grain Size) | | | | |
| FA-324 | 35.8 Al | 2.2 | 51.6 | 59.4 |
| FA-342 | 35.8 Al + 0.1 Zr + 0.24 B | 4.7 | 46.5 | 71.0 |
| FA-350 | 35.8 Al + 0.05 Zr + 0.24 B | 4.5 | 43.5 | 64.1 |
| Room Temperature, Rod Specimens (Fine Grain Size) | | | | |
| FA-324 | | 7.6 | 48.6 | 90.2 |
| FA-342 | | 9.1 | 48.9 | 107.4 |
| FA-350 | | 10.7 | 47.2 | 109.6 |
| 600° C., Sheet Specimens (Coarse Grain Size) | | | | |
| FA-324 | | 20.1 | 48.2 | 57.2 |
| FA-342 | | 20.3 | 54.0 | 65.2 |
| FA-350 | | 19.2 | 48.2 | 59.7 |
| 600° C., Rod Specimens (Fine Grain Size) | | | | |
| FA-324 | | 49.3 | 45.3 | 51.3 |
| FA-342 | | 57.4 | 51.0 | 53.4 |
| FA-350 | | 54.9 | 52.2 | 56.6 |

Table 10 reveals that hot extruded materials with a fine grain structure are much more ductile at room temperature and 600° C. than hot-rolled materials with a coarse grain structure. In addition, Table 10 shows a room-temperature tensile ductility of as high as 10.7% for FA-350 produced by hot extrusion.

From the foregoing, it will be appreciated that the invention provides FeAl iron aluminides which exhibit superior corrosion resistance combined with significantly improved room temperature ductility, high temperature strength and other mechanical properties critical to usefulness in structural applications. The improved alloys based on the FeAl phase employ readily available alloying elements which are relatively inexpensive so that the resulting compositions are subject to a wide range of economical uses.

Although various compositions in accordance with the present invention have been set forth in the foregoing detailed description, it will be understood that these are for purposes of illustration only and are not intended as a limitation on the scope of the appended claims, including all permissible equivalents.

What is claimed is:

1. A corrosion resistant intermetallic alloy, comprising, in atomic percent, an FeAl iron aluminide containing from about 30% to about 40% aluminum alloyed with from about 0.01 to about 0.4% zirconium, boron in an amount no more than about 0.8% wherein the boron/zirconium ratio is at least about 2 to 1, and from about 0.2% Mo to less than about 0.5% Mo, wherein the alloy exhibits improved room temperature ductility.

2. The alloy of claim 1, wherein the boron/zirconium ratio is between about 2 to 1 and 2.5 to 1.

3. The alloy of claim 1, wherein the Zr is present in an amount of about 0.05%, the B is present in an amount of about 0.24% and the Mo is present in an amount of about 0.2%, wherein the alloy has a tensile ductility of about 11.8% at a temperature of about 70° C.

4. The alloy of claim 1, further comprising from about 0.01% to about 0.07% chromium and from about 0.01% to about 2% vanadium, wherein the alloy also exhibits improved strength at high temperatures.

5. A corrosion resistant intermetallic alloy, comprising, in atomic percent, an FeAl iron aluminide containing from about 36% aluminum alloyed with about 0.05% zirconium, about 0.2% boron and carbon, about 0.2% Mo, about 2% Cr, about 0.2% vanadium, and the balance iron, wherein the alloy exhibits improved room temperature ductility.

6. A corrosion resistant intermetallic alloy, comprising, in atomic percent, an FeAl iron aluminide containing from about 35% to about 36% aluminum alloyed with about 0.1% zirconium, about 0.24% boron and about 0.2% Mo, wherein the alloy exhibits a ductility of about 11.8% at a temperature of about 70° C.

* * * * *